US008216083B1

(12) United States Patent
Masucci

(10) Patent No.: US 8,216,083 B1
(45) Date of Patent: Jul. 10, 2012

(54) GOLF PRACTICE APPARATUS

(76) Inventor: G. Thomas Masucci, Pleasanton, CA (US)

( * ) Notice: Subject to any disclaimer, the term of this patent is extended or adjusted under 35 U.S.C. 154(b) by 0 days.

(21) Appl. No.: 12/915,626

(22) Filed: Oct. 29, 2010

(51) Int. Cl.
*A63B 69/36* (2006.01)

(52) U.S. Cl. ..... 473/270; 473/172; 473/197; 473/409

(58) Field of Classification Search ..... 473/150–154, 473/159, 162, 164, 166, 170–174, 193, 194, 473/197, 266, 270, 409
See application file for complete search history.

(56) References Cited

U.S. PATENT DOCUMENTS

| | | | | |
|---|---|---|---|---|
| 920,907 | A | 5/1909 | Bolton | |
| 1,677,442 | A | 7/1928 | Hall | |
| 1,719,240 | A * | 7/1929 | Scanlan | 473/190 |
| 1,788,803 | A | 1/1931 | MacGeorge | |
| 1,989,542 | A | 1/1935 | Boothman | |
| 2,899,208 | A | 8/1959 | Wallsteiner | |
| 3,516,675 | A * | 6/1970 | Gregory et al. | 473/164 |
| 3,986,719 | A * | 10/1976 | Lee | 473/197 |
| 4,723,780 | A | 2/1988 | Vinzetta | |
| 5,149,087 | A * | 9/1992 | Thompson, Jr. | 473/286 |
| 5,492,319 | A | 2/1996 | Lee | |
| 6,889,982 | B1 | 5/2005 | Gove | |
| 6,905,418 | B2 | 6/2005 | Rhee | |
| 2008/0312011 | A1 * | 12/2008 | Edmondson | 473/456 |
| 2009/0280922 | A1 * | 11/2009 | Zhou | 473/238 |

OTHER PUBLICATIONS

P3ProSwing Birdie Package. Backyard Golf. http://www.backyard-putting-greens.com/ProductDetails.asp?ProductCode=P3-Birdie&Click=3145. Accessed Dec. 29, 2009.

* cited by examiner

*Primary Examiner* — Nini Legesse
(74) *Attorney, Agent, or Firm* — Montgomery Patent & Design, LLC; Robert C. Montgomery; Joseph T. Yaksich

(57) ABSTRACT

A golf practice apparatus comprises a chipping mat and a target assembly. The chipping mat comprises a surface from which a user strikes golf balls. The target assembly comprises a frame and a target mat. The frame is further comprised of a lightweight, collapsible framework for supporting a target mat further comprising various markings indicated targets for a user. In a preferred embodiment, the frame is comprised of pipe segments, connecting joints, and a plurality of common fasteners. The target mat is suspended from the frame and attaches via corresponding common fasteners. The target assembly is disposed of various segments to allow a user to simulate short game aspects of golf by choosing a target based upon the desired angle and velocity that the user desires to emulate.

17 Claims, 6 Drawing Sheets

GOLF PRACTICE APPARATUS

RELATED APPLICATIONS

The present invention was first described in a notarized Official Record of Invention on Nov. 23, 2009, that is on file at the offices of Montgomery Patent and Design, LLC, the entire disclosures of which are incorporated herein by reference.

FIELD OF THE INVENTION

The present invention relates generally to golf, and in particular, to an apparatus which provides a means for adjustable short game and chipping training exercises.

BACKGROUND OF THE INVENTION

The game of golf is one of the most popular in the world today. Due to the highly precise nature of the game play, golf also constitutes one (1) of the most technologically advanced sports in the world with regards to equipment. Success in the sport of golf is predicated upon the ability to perform highly accurate movements with a high level of repeatability. As a result, the equipment is engineered to provide a high level of control, and training routines generally involve extensive repetition of various motions including driving, chipping, and putting.

As noted, many aspects of golf such as driving are learned via continuous repeated motion and adaptation to increase the effectiveness of the motion. However, chipping represents an aspect of golf which is largely predicated upon the particulars of technique, accuracy, and consistency and less so on developing a powerful or efficient swinging method such as is the case in driving. Chipping practice generally consists of repeated striking of the ball from a flat surface in order to practice elevating the ball over a short range.

One (1) problem associated with chipping practice is that the efficiency and effectiveness of such short game exercises hinge upon having a suitable location for repeated chipping. Furthermore, if such a location does not provide a variety of suitable targets and positions, the exercise will not be of general use in properly evaluating and executing a wide range of short game shots. This, in turn, limits the practical effectiveness of the short game practice.

Various attempts have been made to provide golf stroke training target assemblies. Examples of these attempts can be seen by reference to several U.S. patents. U.S. Pat. No. 920,907, issued in the name of Bolton, describes a golf practice net sloped towards a user for automatic return of a ball after chipping.

U.S. Pat. No. 1,677,442, issued in the name of Hall, describes an indoor golf apparatus with a plurality of target curtains for practicing variously angled shots.

U.S. Pat. No. 4,723,780, issued in the name of Vinzetta, describes a golf practice device with a single net enclosure with a canopy which catches and retains golf balls for practicing of driving strokes in a small or enclosed location.

U.S. Pat. No. 5,492,319, issued in the name of Lee, describes an indoor golf chip shot practice apparatus comprising a chipping mat and a frame enclosed on all sides by netting for automatic ball return.

While these devices fulfill their respective, particular objectives, each of these references suffer from one (1) or more of the aforementioned disadvantages. Many such devices do not provide a wide range of targeting options without reconfiguration or repositioning. Also, many such devices do not provide realistic hitting surfaces. Furthermore, many such devices make it difficult to track the outcome of previous attempts in order to adjust future strokes as is desirable when training. In addition, many such devices do not provide guidance or indications which allow the user to accurately and consistently practice proper stance and positioning in order to form good habits. Accordingly, there exists a need for a golf short game practice apparatus without the disadvantages as described above. The development of the present invention substantially departs from the conventional solutions and in doing so fulfills this need.

SUMMARY OF THE INVENTION

In view of the foregoing references, the inventor recognized the aforementioned inherent problems and observed that there is a need for a golf short game practice apparatus which provides realistic, repeatable, customizable, and consistent golf stroke practicing opportunities in an enclosed space and in a manner which allows the user to track their shots and adjust their technique accordingly. Thus, the object of the present invention is to solve the aforementioned disadvantages and provide for this need.

To achieve the above objectives, it is an object of the present invention to provide a practice apparatus for improving golf chip shots or other short game shots. The apparatus comprises a chipping mat and a target assembly. A user stands on the chipping mat and strikes a golf ball toward the target assembly with a golf club.

Another object of the present invention is to provide a simulative chipping surface for use over an existing indoor or outdoor ground surface. The chipping mat comprises a material such as artificial turf which provides similar properties to golf course surfaces.

Yet still another object of the present invention is to assist the user in practicing their golfing stance and swing with a plurality of indicia disposed on an upper surface of the chipping mat. The indicia include left and right foot alignment indicia, balancing instructions, and visual indication of the user's center point.

Yet still another object of the present invention is to provide a plurality of positions from which the ball may be struck from the chipping mat. The chipping mat comprises a plurality of ball indicia which provide repeatable positioning of the ball in a number of positions. Each ball indicia is further aligned with corresponding ball position indicia which aid the user in aligning their stance with the golf ball.

Yet still another object of the present invention is to provide visual targeting for the user with the target assembly. The target assembly comprises a target frame and a target mat.

Yet still another object of the present invention is to facilitate disassembly and storage of the target frame and target mat by removing the target mat from the frame and collapsing the frame.

Yet still another object of the present invention is to provide a club holder located along a vertical member of the target frame for leaning retention of a golf club.

Yet still another object of the present invention is to construct the target mat of a material which enables a golf ball to temporarily leave an indentation so that the user can analyze the result of a previous shot.

Yet still another object of the present invention is to provide a plurality of indicia located along a front surface of the target mat. The indicia comprise indicating matrix indicia and a center hit position indicium. The matrix facilitates analysis of the accuracy of a previously hit shot with regards to the center hit position indicium.

Yet still another object of the present invention is to provide a method of utilizing the device that provides a unique means of acquiring an instance of the apparatus, assembling the target frame in a desired location, attaching the target mat to the target frame, positioning the chipping mat in a location in front of and aligned with the target assembly, placing a golf ball on a desired ball position indicium, aligning feet and stance in accordance with the indicia on the chipping mat, striking the golf ball with a golf club towards the target assembly, analyzing the outcome of the shot based upon the indentation left by the ball in the target mat, repeating shots from various positions as desired, stowing the golf club gains the target frame in a leaning manner as desired, and collapsing the target assembly for storage or transport during periods of non-use.

Further objects and advantages of the present invention will become apparent from a consideration of the drawings and ensuing description.

BRIEF DESCRIPTION OF THE DRAWINGS

The advantages and features of the present invention will become better understood with reference to the following more detailed description and claims taken in conjunction with the accompanying drawings, in which like elements are identified with like symbols, and in which:

| DESCRIPTIVE KEY | |
|---|---|
| 10 | golf short game practice apparatus |
| 11 | user |
| 12 | golf club |
| 13 | golf ball |
| 20 | chipping mat |
| 21 | chipping mat upper surface |
| 22 | left foot indicia |
| 23 | right foot indicia |
| 24 | directional indicia |
| 25 | ball indicia |
| 26 | training block indicia |
| 27 | center position indicia |
| 28 | ball position indicia |
| 30 | target assembly |
| 31 | target frame |
| 32 | horizontal member |
| 33 | vertical member |
| 34 | footing member |
| 35 | attachment member |
| 36 | attachment member aperture |
| 40 | target mat |
| 41 | target mat upper surface |
| 42 | target mat aperture |
| 43 | fastener |

-continued

| DESCRIPTIVE KEY | |
|---|---|
| 44 | indication indicia |
| 45 | center hit position indicia |
| 46 | club holder |
| 47 | target mat lower surface |

DETAILED DESCRIPTION OF THE PREFERRED EMBODIMENT

The best mode for carrying out the invention is presented in terms of its preferred embodiment, herein depicted within FIGS. 1 through 6. However, the invention is not limited to the described embodiment and a person skilled in the art will appreciate that many other embodiments of the invention are possible without deviating from the basic concept of the invention, and that any such work around will also fall under scope of this invention. It is envisioned that other styles and configurations of the present invention can be easily incorporated into the teachings of the present invention, and only one particular configuration shall be shown and described for purposes of clarity and disclosure and not by way of limitation of scope.

The terms "a" and "an" herein do not denote a limitation of quantity, but rather denote the presence of at least one of the referenced items.

Figure 1:
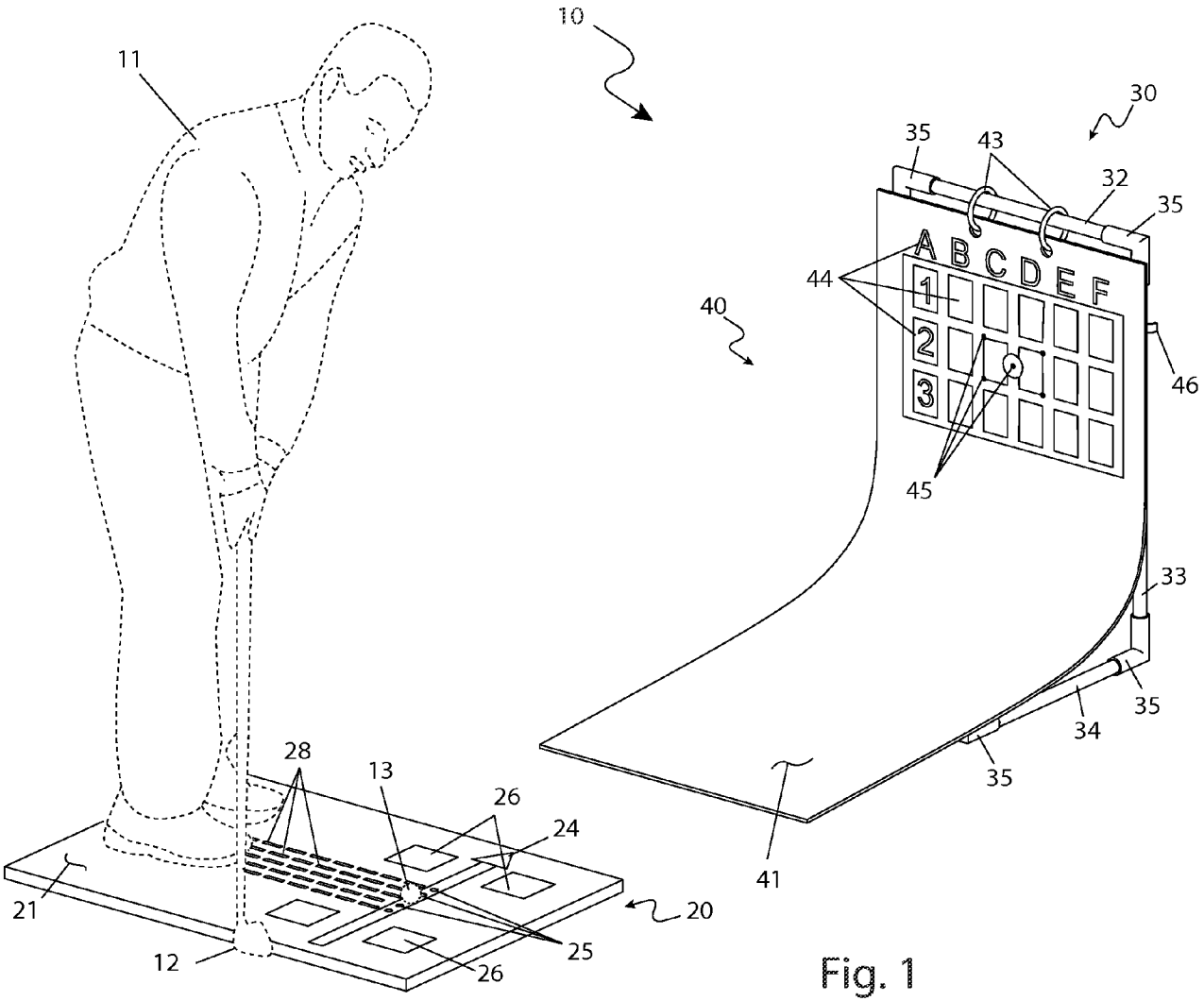
FIG. 1 is an environmental view of a golf short game practice apparatus 10, according to a preferred embodiment of the present invention.

The present invention describes a golf practice apparatus (herein described as the "apparatus") 10, which provides a practice system for improving chip shots or other short game shots in the game of golf. Referring now to FIG. 1, an environmental view of the apparatus 10, according to the preferred embodiment of the present invention, is disclosed. The apparatus 10 comprises a chipping mat 20 and a target assembly 30 which enables a user 11 to stand upon said chipping mat 20 and strike a golf ball 13 toward said target assembly 30 via a golf club 12. The apparatus 10 is utilized with various golf clubs 12. The apparatus 10 is transported to a desired level surface indoors or outdoors.

Figure 2:
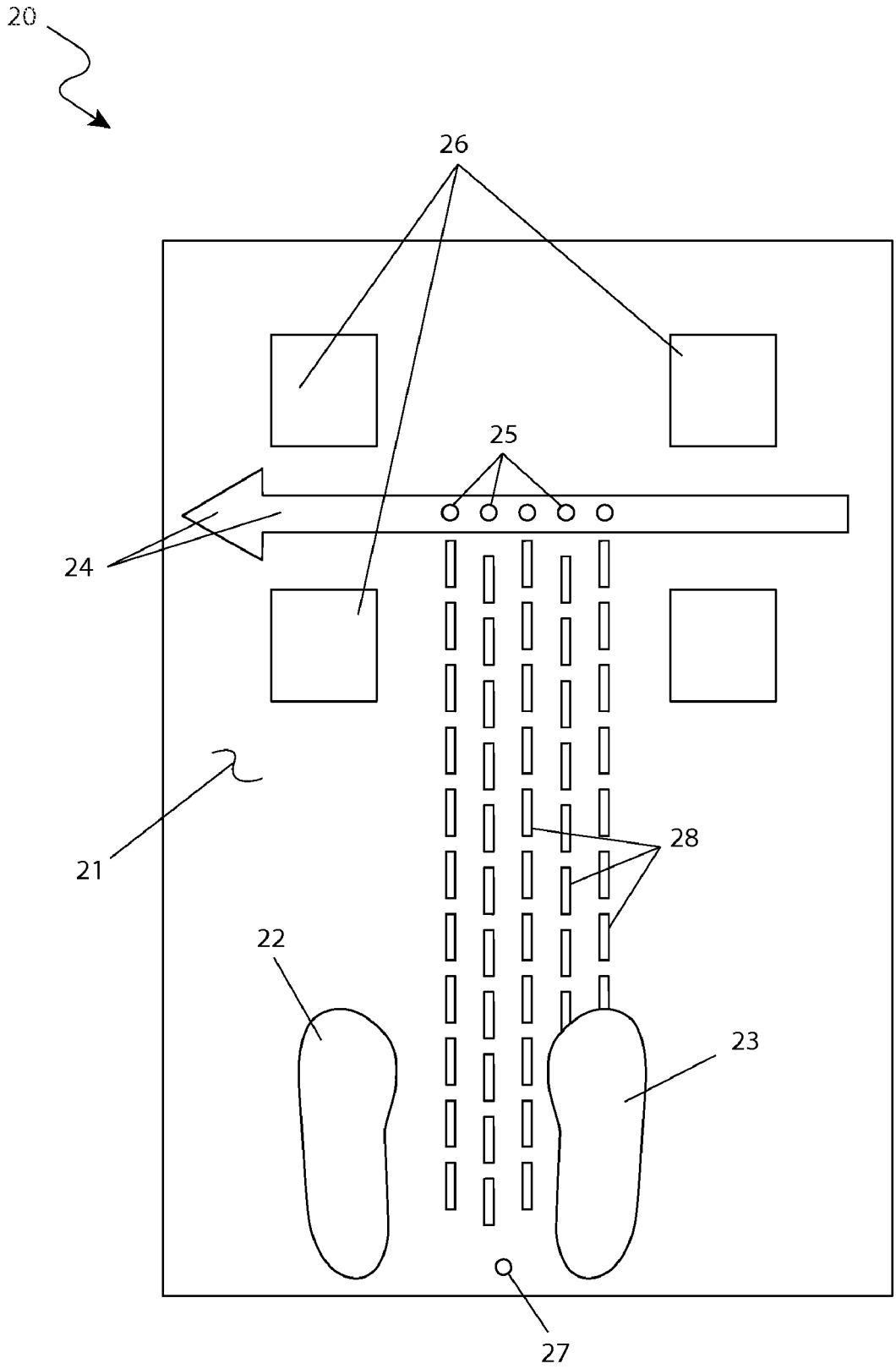
FIG. 2 is a front view of a foot mat 20, according to a preferred embodiment of the present invention.

Referring now to FIG. 2, a front view of a chipping mat 20, according to the preferred embodiment of the present invention, is disclosed. The apparatus 10 comprises a chipping mat 20 which provides a means to prefect the user's 11 golfing stance, swing, and striking of the golf ball 13. The chipping mat 20 is preferably comprised of a rectangular pad of artificial turf, yet other materials and shapes may be utilized without limiting the scope of the apparatus 10. The chipping mat 20 is situated approximately fifty-five (55) inches away from a target assembly 30 (see FIGS. 3 and 4) in a parallel orientation to enable the golf ball 13 to properly strike said target assembly 30. A chipping mat upper surface 21 comprises a plurality of indicia which assist the user 11 in perfecting their golfing stance, swing, and strike.

The chipping mat upper surface 21 comprises left foot indicia 22 and right foot indicia 23 which provide a means to properly align the user's 11 feet. The foot indicia 22, 23 is located on a distal portion of the chipping mat upper surface 21, yet other locations may be utilized without limiting the scope of the apparatus 10. The foot indicia 22, 23 may also comprise alphanumeric indicia comprising statements such as, but not limited to: "Left 70% Weight Shift," "Right 30% Weight Shift," or the like which remind the user 11 how to balance their weight during movements which pertain to striking the golf ball 13. Positioned between the heel portions of the foot indicia 22, 23 is a center position indicia 27 which provides a visual indication of the user's 11 center point. The center position indicia 27 comprises a solid circular form with a diameter similar to that of a golf ball 13.

The chipping mat upper surface 21 also comprises directional indicia 24 which enables the user 11 to visualize the path of the golf ball 13 and the swing path of the golf club 12. The directional indicial 24 comprises an arrow form, yet other forms may be utilized without limiting the scope of the apparatus 10. The directional indicia 24 is located on an proximal portion of the chipping mat upper surface 21, yet other locations may be utilized without limiting the scope of the apparatus 10. Positioned within the directional indicia 24 is a plurality of ball indicia 25 which provide a position to place the golf ball 13. The ball indicia 25 are comprised of circular forms which comprise a diameter similar to the diameter of a golf ball 13. Each of the ball indicia 25 is aligned with a corresponding ball position indicia 28 which provides a means to assist the user 11 in aligning their stance with the golf ball 13. The ball position indicia 28 comprises parallel dashed lines located from a distal intermediate portion of the foot indicia 22, 23 to an intermediate portion of the directional indicia 24.

The chipping mat upper surface 21 further comprises a plurality of training block indicia 26 which provides a means to control the user's 11 swing of the golf club 12. Each training block indicia 26 comprises a rectangular-shape and are located above and below the directional indicia 24. The training blocks 26 enable the user 11 to refine desired short game shots.

Figure 3:
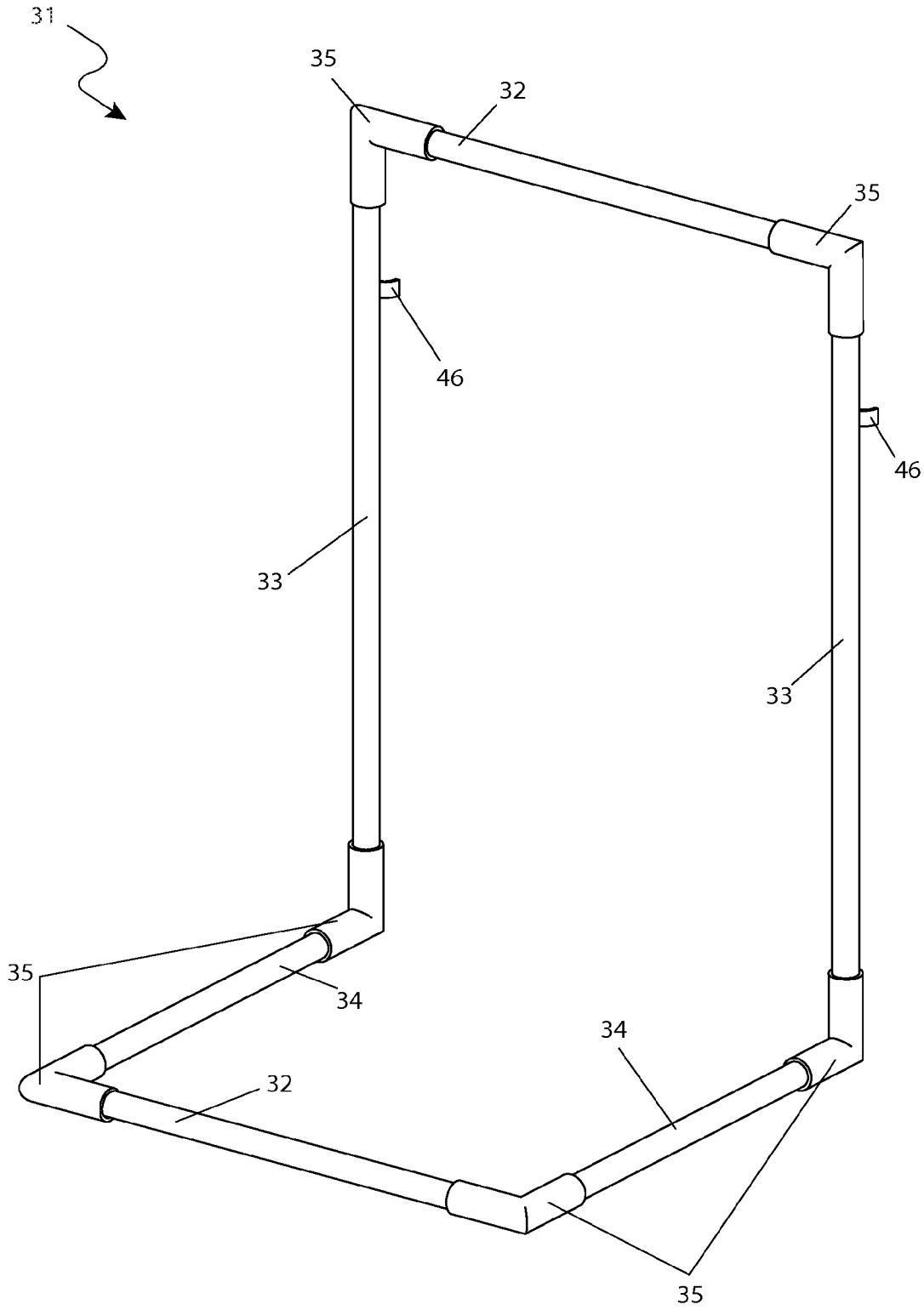
FIG. 3 is a perspective view of a target frame 31, according to a preferred embodiment of the present invention.
Figure 4:
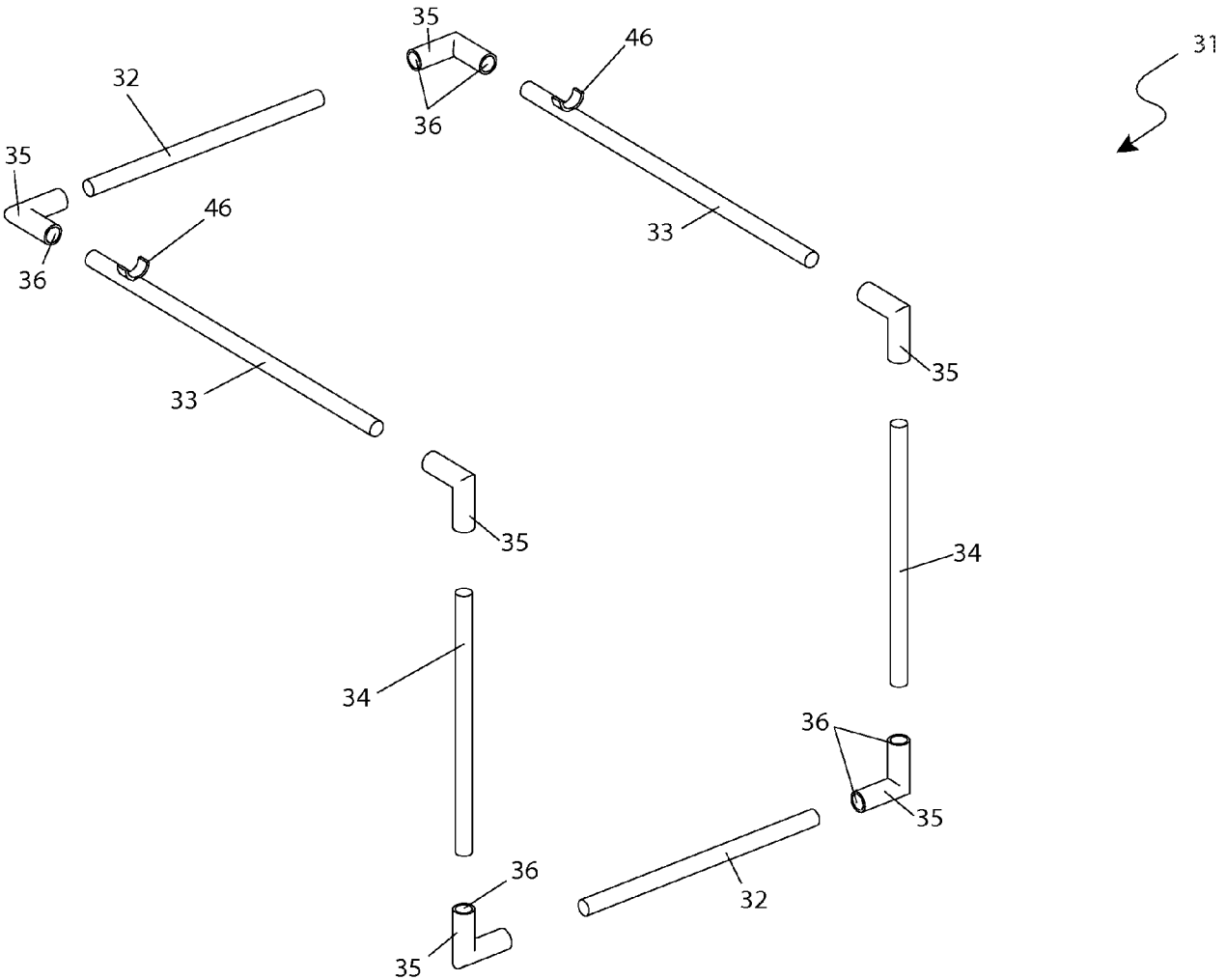
FIG. 4 is an exploded view of the target frame 31, according to a preferred embodiment of the present invention.

Referring now to FIG. 3, a perspective view of a target frame 31 and FIG. 4, an exploded view of the target frame 31, according to the preferred embodiment of the present invention, are disclosed. The apparatus 10 comprises a target assembly 30 which provides a collapsible target for the user 11 to aim the golf ball 13. The target assembly 30 comprises a target frame 31 and a target mat 40 (also see FIGS. 5 and 6) which provides an upright structure for the golf ball 13 to strike. The target frame 31 comprises an "L"-shape and is able to be disassembled for storage means. The target frame 31 is fabricated from materials such as, but not limited to polyvinyl chloride (PVC), metal, or the like. The target assembly 32 comprises a pair of horizontal members 32, a pair of vertical members 33, a pair of footing members 34, and a plurality of attachment members 35. The horizontal members 32, vertical members 33, and footing members 34 each preferably comprise tubular-shaped male pipes which engages the attachment means 35, each preferably comprising of a ninety degree (90°) female elbow member. The horizontal members 32 each measure approximately thirty (30) inches in length, the vertical members 33 each measure approximately twenty-seven (27) inches in length, and the footing members 34 measure approximately twelve (12) inches in length. Each attachment means 35 comprises a pair of attachment member apertures 36 which enable the horizontal members 32, vertical members 33, and footing members 34 to engage via a slip fitting means, yet other fitting means may be utilized without limiting the scope of the apparatus 10. The diameter of the attachment member apertures 36 is slightly larger than the diameter of the vertical members 33, and footing members 34.

Each vertical member 33 comprises a club holder 46 which provides a means to lean a golf club 12. The club holders 46 comprise an arcuate shape and are preferably integrally molded into each vertical member 33 along an upper rear surface of said vertical members 33.

Figure 5:
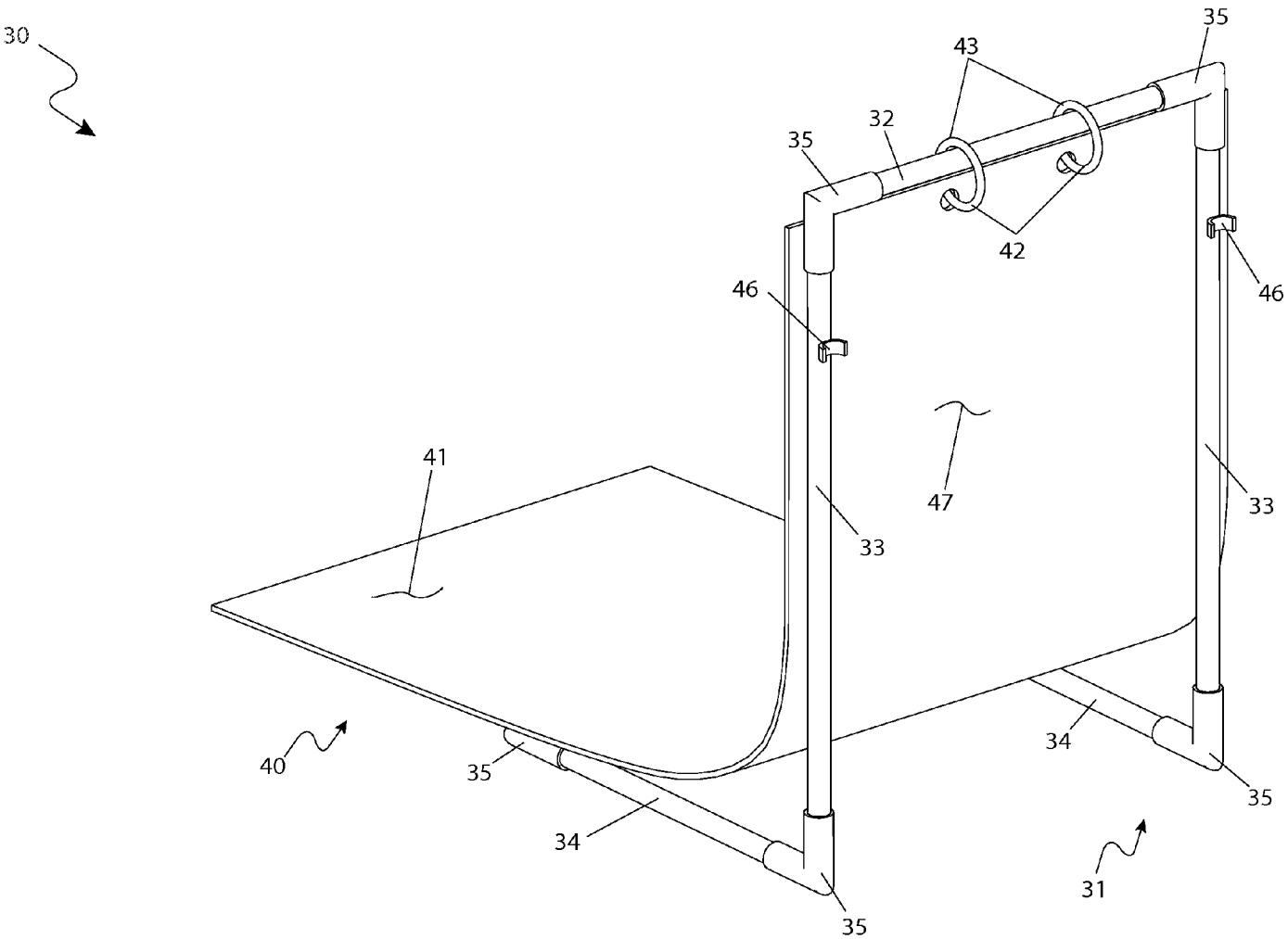
FIG. 5 is a rear perspective view of a target assembly 30 depicting an attached target mat 40, according to a preferred embodiment of the present invention; and, FIG. 6 is a front view of the target mat 40, according to a preferred embodiment of the present invention.
Figure 6:
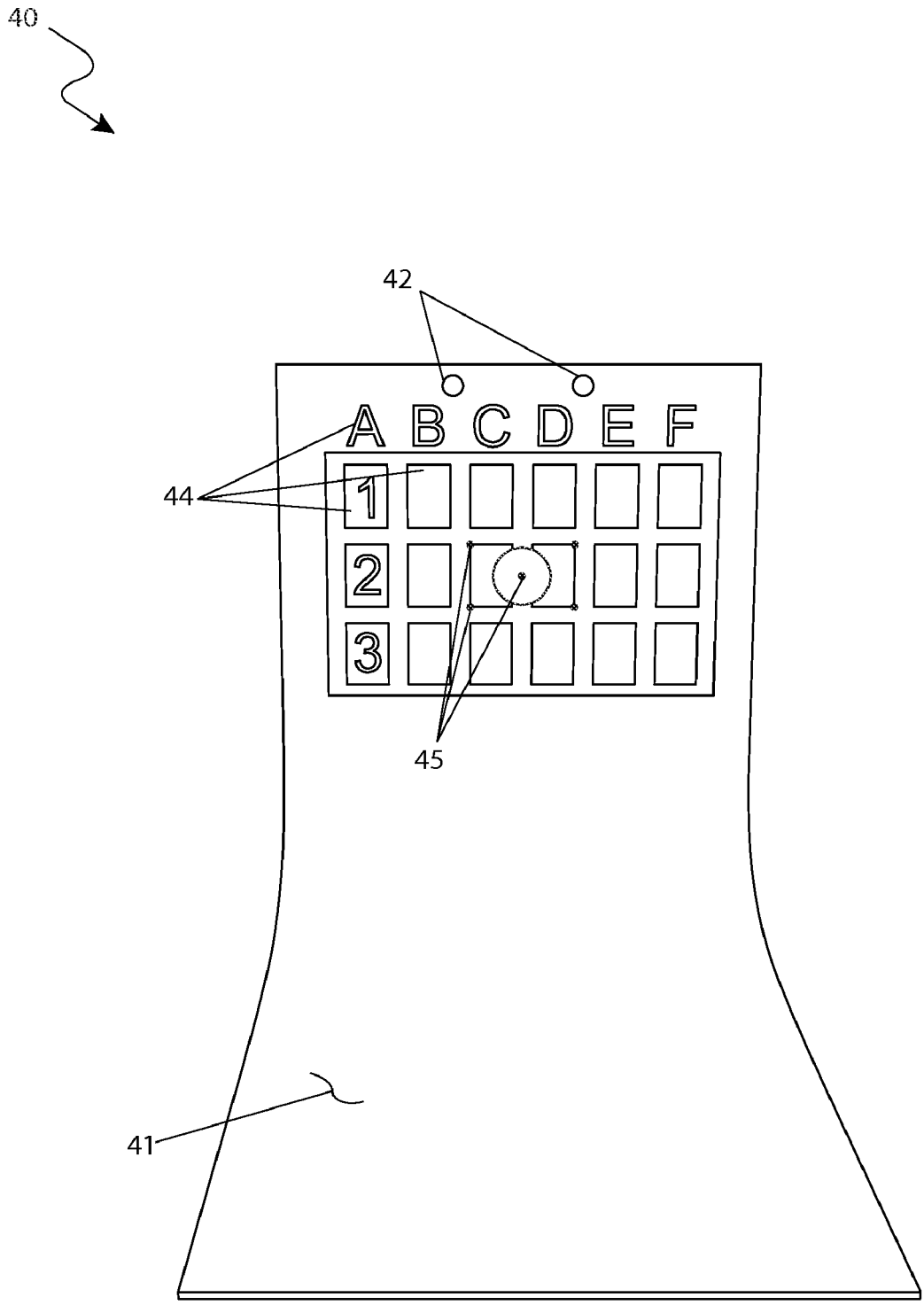

Referring now to FIG. 5, a rear perspective view of a target assembly 30 depicting an attached target mat 40 and FIG. 6, a front view of the target mat 40, according to the preferred embodiment of the present invention, are disclosed. The target assembly 30 also comprises the target mat 40 which comprises a rectangular form further comprised preferably of common visco-elastic polyurethane foam which enables an indentation of a struck golf ball 13 to temporarily remain upon said target mat 40 for analyzing the shot, yet other materials may be utilized without limiting the scope of the apparatus 10. The target mat 40 is suspended from the upper horizontal member 32 via a pair of fasteners 43 inserted through corresponding target mat apertures 42 and positioned around said horizontal members 32. The fasteners 42 are illustrated herein as conventional zip ties or cable ties, yet other fastening means may be utilized without limiting the scope of the apparatus 10.

The target mat 40 comprising an upper surface 41 and a lower surface 47 is positioned in a draping manner with a target mat upper surface 41 oriented upwardly and provides a plurality of indicia to assist the user 11 during use. Positioned on an upper portion of the mat upper surface 41 is a plurality of indication indicia 44 and center hit position indicia 45. The indication indicia 44 comprises a matrix further comprising alphanumeric characters which correspond to the golf ball 13 struck area upon the mat upper surface 41 which enables the user 11 to visually determine where said golf ball 13 struck. The center hit position indicia 45 comprises a circular form which informs the user 11 where the center point on the upper portion of the mat upper surface 41 is located. Although the indication indicia 44 and center hit position indicia 45 are depicted as abovementioned it is known that various indicia, shapes, photographs, or the like which may increase the user's 11 short game shot without limiting the scope of the apparatus 10 may be utilized.

It is envisioned that other styles and configurations of the present invention can be easily incorporated into the teachings of the present invention, and only one particular configuration shall be shown and described for purposes of clarity and disclosure and not by way of limitation of scope.

The preferred embodiment of the present invention can be utilized by the common user in a simple and effortless manner with little or no training. After initial purchase or acquisition of the apparatus 10, it would be installed as indicated in FIG. 1.

The method of installing target assembly 30 may be achieved by performing the following steps: acquiring the target assembly 30; positioning a horizontal member 32 on the desired level surface with an attachment means 35 attached to each end; inserting the footing members 34 into the previously attached attachment means 35 oriented in a perpendicular manner; inserting a pair of attachment means 35 onto each end portions of the previously attached footing members 34, thereby enabling the vertical members 33 to be inserted within said attachment means 35 in a perpendicular orientation with the club holders 46 positioned rearwardly; installing attachment means 35 to each end portions of the vertical members 33 to enable attachment of the other horizontal member 32; attaching the target mat 40 with the target mat upper surface 41 oriented upwardly onto the upper horizontal member 32 via inserting the fasteners 43 through each target mat aperture 42 and fastening around said horizontal member; leaning golf clubs 12 upon the club holders 46; and utilizing the target mat upper surface to strike the golf ball 13 upon.

The method of installing and utilizing the chipping mat 20 may be achieved by performing the following steps: acquiring the chipping mat 20; positioning the chipping mat 20 with the chipping mat upper surface 21 positioned upwardly upon a desired level surface approximately at the desired distance away from the target assembly 30; enabling the user 11 to stand upon the foot indicia 23, 24; enabling the user 11 to position the golf ball 13 upon the ball position indicia 28; utilizing the directional indicia 24, center position indicia 27, and training block indicia 26 to perfect short game shots as desired; striking the golf ball off of the chipping mat 20 toward the target assembly 30; and repeating as desired.

The foregoing descriptions of specific embodiments of the present invention have been presented for purposes of illustration and description. They are not intended to be exhaustive or to limit the invention and method of use to the precise forms disclosed. Obviously many modifications and variations are possible in light of the above teaching. The embodiment was chosen and described in order to best explain the principles of the invention and its practical application, and to thereby enable others skilled in the art to best utilize the invention and various embodiments with various modifications as are suited to the particular use contemplated. It is understood that various omissions or substitutions of equivalents are contemplated as circumstance may suggest or render expedient, but is intended to cover the application or implementation without departing from the spirit or scope of the claims of the present invention.

What is claimed is:

1. A golf practice apparatus for improving a short game golf shot, said golf practice apparatus comprising:

a chipping mat positioned on a ground surface and adapted to align a user and a golf ball thereon, said chipping mat comprising an upper surface comprising:

left and right foot indicia located on a distal portion of said upper surface;

a center position indicia located on said distal portion;

a directional indicia having an arrow located on a proximal portion of said upper surface of said chipping mat, said arrow being oriented orthogonal to a longitudinal length of said chipping mat;

a plurality of ball indicia positioned within said directional indicia, said ball indicia capable of providing a position to place said golf ball; and, a plurality of ball position indicia having parallel dashed lines extending from a distal intermediate portion of said left and right foot indicia to an intermediate portion of said directional indicia;

wherein each of said ball indicia is aligned with a corresponding one of said ball position indicia and thereby capable of aligning a stance of a user with said golf ball; and, a collapsible target assembly positioned on a ground surface and spaced from said chipping mat, said target assembly adapted to receive a golf ball struck from said chipping mat;

wherein said target assembly includes a target mat capable of analyzing the golf shot, said target mat being selectively indented when adapted to receive the struck golf ball, said target mat being positioned in a draping manner with an upper surface of said target mat being oriented upwardly and away from said chipping mat.

2. The golf practice apparatus of claim 1, wherein said center position indicia and said ball indicia are circular, wherein said center position indicia is positioned between heel portions of said left and right foot indicia and thereby provides a visual indication of a user center point, wherein said directional indicia is capable of enabling the user to visualize a path of the golf ball and a swing path of a golf club.

3. The golf practice apparatus of claim 1, wherein said upper surface of said chipping mat further comprises: a plurality of rectangular-shaped training block indicia located above and below said directional indicia, said training block indicia being capable of controlling and refining the user swing of the golf club for short game golf shots.

4. The golf practice apparatus of claim 1, wherein said target assembly further comprises: a target frame attached to said target mat, said target frame and said target mat being capable of providing an upright structure for the golf ball to strike, said target frame being selectively assembled and disassembled during use and storage conditions.

5. The golf practice apparatus of claim 4, wherein said target frame comprises:

a plurality of horizontal, vertical, footing and attachment members respectively engaged in such a manner to define a free-standing L-shaped structure; and, an arcuate shaped club holder located on an upper rear surface of said vertical members and being capable of receiving a leaning golf club thereagainst.

6. The golf practice apparatus of claim 4, wherein said target mat comprises:

a plurality of apertures; and, a plurality of fasteners passing through said apertures and positioned about an upper one of said horizontal members such that said target mat is suspended from said upper horizontal member.

7. The golf practice apparatus of claim 1, wherein said upper surface of said target mat comprises:

a plurality of indication indicia positioned on an upper portion thereof; and, circular center hit position indicia connected to selected ones of said indication indicia;

wherein one of said center hit position indicia indicates a center point on said upper portion of said mat upper surface.

8. The golf practice apparatus of claim 7, wherein said indication indicia comprises: a matrix comprising alphanumeric characters being capable of visually indicating a golf ball strike location.

9. A golf practice apparatus for improving a short game golf shot, said golf practice apparatus comprising:

a chipping mat positioned on a ground surface and adapted to align a user and a golf ball thereon, said chipping mat comprising an upper surface comprising:

left and right foot indicia located on a distal portion of said upper surface of said chipping mat;

a center position indicia located on said distal portion;

a directional indicia having an arrow located on a proximal portion of said upper surface of said chipping mat, said arrow being oriented orthogonal to a longitudinal length of said chipping mat;

a plurality of ball indicia positioned within said directional indicia, said ball indicia capable of providing a position to place the golf ball; and, a plurality of ball position indicia having parallel dashed lines extending from a distal intermediate portion of said left and right foot indicia to an intermediate portion of said directional indicia;

wherein each of said ball indicia is aligned with a corresponding one of said ball position indicia and thereby capable of aligning a stance of the user with the golf ball; and, a collapsible target assembly positioned on a ground surface and spaced from said chipping mat, said target assembly adapted to receive a golf ball struck from said chipping mat;

wherein said target assembly includes a target mat formed from visco-elastic material and being capable of analyzing the golf shot, said target mat being selectively indented when adapted to receive the struck golf ball, said target mat being positioned in a draping manner with an upper surface of said target mat being oriented upwardly and away from said chipping mat.

10. The golf practice apparatus of claim 9, wherein said center position indicia and said ball indicia are circular, wherein said center position indicia is positioned between heel portions of said left and right foot indicia and thereby provides a visual indication of a user center point, wherein said directional indicia is capable of enabling the user to visualize a path of the golf ball and a swing path of a golf club.

11. The golf practice apparatus of claim 9, wherein said upper surface of said chipping mat further comprises: a plurality of rectangular-shaped training block indicia located above and below said directional indicia, said training block indicia being capable of controlling and refining the user swing of the golf club for short game golf shots.

12. The golf practice apparatus of claim 9, wherein said target assembly further comprises: a target frame attached to said target mat, said target frame and said target mat being capable of providing an upright structure for the golf ball to strike, said target frame being selectively assembled and disassembled during use and storage conditions.

13. The golf practice apparatus of claim 12, wherein said target frame comprises:

a plurality of horizontal, vertical, footing and attachment members respectively engaged in such a manner to define a free-standing L-shaped structure; and, an arcuate shaped club holder located on an upper rear surface of said vertical members and being capable of receiving a leaning golf club thereagainst.

14. The golf practice apparatus of claim 12, wherein said target mat comprises:

a plurality of apertures; and, a plurality of fasteners passing through said apertures and positioned about an upper one of said horizontal members such that said target mat is suspended from said upper horizontal member.

15. The golf practice apparatus of claim 9, wherein said upper surface of said target mat comprises:

a plurality of indication indicia positioned on an upper portion thereof; and, circular center hit position indicia connected to selected ones of said indication indicia;

wherein one of said center hit position indicia indicates a center point on said upper portion of said mat upper surface.

16. The golf practice apparatus of claim 15, wherein said indication indicia comprises: a matrix comprising alphanumeric characters being capable of visually indicating a golf ball strike location.

17. A method of utilizing a golf practice apparatus for improving a short game golf shot, said method comprising the steps of:

providing and positioning a chipping mat on a ground surface, said chipping mat comprising an upper surface comprising:

left and right foot indicia located on a distal portion of said upper surface of said chipping mat;

a center position indicia located on said distal portion;

a directional indicia having an arrow located on a proximal portion of said upper surface of said chipping mat, said arrow being oriented orthogonal to a longitudinal length of said chipping mat;

a plurality of ball indicia positioned within said directional indicia, said ball indicia capable of providing a position to place the golf ball; and, a plurality of ball position indicia having parallel dashed lines extending from a distal intermediate portion of said left and right foot indicia to an intermediate portion of said directional indicia;

wherein each of said ball indicia is aligned with a corresponding one of said ball position indicia and thereby capable of aligning a stance of the user with the golf ball;

providing and positioning a collapsible target assembly on a ground surface spaced from said chipping mat, said target assembly including a target mat formed from visco-elastic material and capable of analyzing the golf shot;

positioning said target mat in a draping manner by orienting an upper surface of said target mat upwardly and away from said chipping mat;

causing said chipping mat to align a user and a golf ball thereon; and, said target assembly receiving the golf ball struck from said chipping mat and thereby being selectively indented upon impact.

* * * * *